US011710920B2

(12) United States Patent
Akaike et al.

(10) Patent No.: US 11,710,920 B2
(45) Date of Patent: Jul. 25, 2023

(54) ELECTRICAL CONNECTOR AND METHOD FOR MOUNTING ELECTRICAL CONNECTOR

(71) Applicants: Takahiro Akaike, Tokyo (JP); Satoshi Goto, Tokyo (JP); Isao Suzuki, Tokyo (JP)

(72) Inventors: Takahiro Akaike, Tokyo (JP); Satoshi Goto, Tokyo (JP); Isao Suzuki, Tokyo (JP)

(73) Assignee: MITSUMI ELECTRIC CO., LTD., Tokyo (JP)

( * ) Notice: Subject to any disclaimer, the term of this patent is extended or adjusted under 35 U.S.C. 154(b) by 65 days.

(21) Appl. No.: 17/474,109

(22) Filed: Sep. 14, 2021

(65) Prior Publication Data

US 2022/0102891 A1 Mar. 31, 2022

(30) Foreign Application Priority Data

Sep. 25, 2020 (JP) ..... 2020-160479

(51) Int. Cl.
*H01R 12/57* (2011.01)
*H01R 13/05* (2006.01)
(Continued)

(52) U.S. Cl.
CPC ..... *H01R 13/052* (2013.01); *H01R 12/57* (2013.01); *H01R 13/5045* (2013.01);
(Continued)

(58) Field of Classification Search
CPC .. H01R 13/052; H01R 12/57; H01R 13/5045; H01R 13/516; H01R 13/631;
(Continued)

(56) References Cited

U.S. PATENT DOCUMENTS 4,861,271 A * 8/1989 Bogar ..... H01R 24/545 439/675
6,409,519 B1 * 6/2002 Bacon ..... H01R 24/42 439/63
(Continued)

FOREIGN PATENT DOCUMENTS

EP 0524426 8/1997
JP 2006-12498 1/2006

OTHER PUBLICATIONS

EPO, Search Report of EP 21197949.7 dated May 18, 2022.

*Primary Examiner* — Truc T Nguyen
(74) *Attorney, Agent, or Firm* — Lex IP Meister, PLLC

(57) ABSTRACT

The plug shell of the electrical connector includes the accommodation portion for accommodating the contact pin and the housing that holds the contact pin, the insertion port for inserting the contact pin and the housing into the accommodation portion, the lid member for closing the insertion port, and the hold mechanism for holding the lid member. The hold mechanism includes the pedestal, on which the lid member is placed, and the pair of hold pieces, which hold the lid member on the pedestal by pressing. The pair of hold pieces press the end portions of the lid member toward the pedestal, so that thereby a stress that urges the end portions to become distant from the pedestal is generated in the lid member.

5 Claims, 16 Drawing Sheets

(51) Int. Cl.

| | |
|---|---|
| ***H01R 13/504*** | (2006.01) |
| ***H01R 13/516*** | (2006.01) |
| ***H01R 13/631*** | (2006.01) |
| ***H01R 24/86*** | (2011.01) |

(52) U.S. Cl.
CPC ..... *H01R 13/516* (2013.01); *H01R 13/631* (2013.01); *H01R 24/86* (2013.01)

(58) Field of Classification Search
CPC ..... H01R 24/86; H01R 12/724; H01R 24/50; H01R 13/504; H01R 13/6581; H01R 13/40; H01R 13/502; H01R 43/20
See application file for complete search history.

(56) References Cited

U.S. PATENT DOCUMENTS

| | | | | |
|---|---|---|---|---|
| 6,447,335 | B1 * | 9/2002 | Ko | H01R 9/0518 439/585 |
| 10,063,024 | B2 * | 8/2018 | Yao | H01R 12/724 |
| 2010/0068927 | A1 * | 3/2010 | Ho | H01R 9/0518 439/582 |
| 2010/0311272 | A1 * | 12/2010 | Chien | H01R 24/46 439/578 |
| 2013/0090009 | A1 * | 4/2013 | Zhao | H01R 13/6456 439/607.01 |
| 2017/0222368 | A1 * | 8/2017 | Morello | H01R 24/40 |
| 2019/0296480 | A1 | 9/2019 | Oomori | |
| 2020/0274298 | A1 | 8/2020 | Hashimoto et al. | |
| 2022/0399680 | A1 * | 12/2022 | Mizutani | H01R 13/53 |

* cited by examiner

ELECTRICAL CONNECTOR AND METHOD FOR MOUNTING ELECTRICAL CONNECTOR

This application is based upon, and claims the benefit of priority from, corresponding Japanese Patent Application No. 2020-160479 filed in the Japan Patent Office on Sep. 25, 2020, the entire contents of which are incorporated herein by reference.

BACKGROUND OF THE INVENTION

Technical Field

Generally, the present invention relates to an electrical connector and a method for mounting an electrical connector, and, more specifically, relates to an electrical connector equipped with a plug shell, which includes an insertion port into which a contact pin is inserted and a lid member for closing the insertion port, and to a method for mounting the electrical connector.

Background Art

For providing an electrical connection between a cable or a device and another cable or another device, a combination of a receptacle connector and a plug connector is widely used. For example, as illustrated in FIG. 1, Patent Document: JP 2006-12498A discloses the plug connector 500 for connecting the cable 600 to another device. As illustrated in FIG. 1, the plug connector 500 is attached to the tip of the cable 600.

In FIG. 2, a cross-sectional view of the plug connector 500 and the cable 600 is illustrated. As illustrated in FIG. 2, in the state where the plug connector 500 is attached to the tip of the cable 600, the contact pin 510 of the plug connector 500 is electrically connected to the core wire 610 of the cable 600 via the conductive component 540 inside the metal plug shell 520 of the plug connector 500. Further, a tip portion of the contact pin 510 is exposed inside the circular cylindrical portion 521 of the plug shell 520. Further, a large part of the plug shell 520 is covered with the cover 530 for protecting the plug shell 520, and the circular cylindrical portion 521 of the plug shell 520 is exposed out of the cover 530 toward the tip side (the receptacle connector 700 side).

By connecting the plug connector 500 as such to the receptacle connector 700, which is attached to another device, it becomes easy to electrically connect the cable 600 and another device or another cable. Specifically, by engaging the circular cylindrical portion 521 of the plug shell 520 of the plug connector 500 with the metal cylindrical portion 710 of the receptacle connector 700, the tip portion of the contact pin 510 of the plug connector 500 is inserted into the central hole 720 of the cylindrical portion 710, so that the plug connector 500 and the receptacle connector 700 are electrically connected. In this case, the cable 600 and another device are electrically connected via the plug connector 500 and the receptacle connector 700.

Further, as illustrated in FIG. 2, the contact pin 510 is held by the insulating housing 522 inside the plug shell 520. In the state where the contact pin 510 is held by the housing 522, the base end portion of the contact pin 510 is in contact with the conductive component 540. Since the conductive component 540 is in contact with the core wire 610 of the cable 600, the contact pin 510 and the core wire 610 of the cable 600 are electrically connected via the conductive component 540.

When assembling the plug connector 500, multiple components including the contact pin 510 and the housing 522 need to be inserted into the plug shell 520. Therefore, the insertion port 523 for inserting the components into the plug shell 520 is formed on the face of base end side (the right side in FIG. 2) of the plug shell 520. On the other hand, in order to improve the noise immunity of the plug connector 500, it is preferable that the insertion port 523 of the plug shell 520 is closed with a conductive member. Therefore, as illustrated in FIG. 2, the insertion port 523 of the plug shell 520 is closed with the lid member 524 which is configured with a metal material.

The lid member 524 is fixed onto the plug shell 520 so as to close the insertion port 523. For fixing the lid member 524 onto the plug shell 520, it is often the case that a fixation method with crimping is used. For example, the fixation method with crimping is performed by the procedure illustrated in FIGS. 3A and 3B. FIGS. 3A and 3B are cross-sectional views of the insertion port 523 and lid member 524 of the plug shell 520. Note that, for ease of explanation of the fixation method with crimping, some parts of the plug shell 520 and the lid member 524 are omitted or modified in FIGS. 3A and 3B.

The fixation method with crimping is performed by bending the tip portions of the pair of hold pieces 526 extending from the end faces 525 of the insertion port 523, so that the tip portions are pressed toward the lid member 524 and thus the lid member 524 is nipped. First, as illustrated in FIG. 3A, the lid member 524 is placed on the end faces 525 of the insertion port 523 of the plug shell 520. Thereafter, as illustrated in FIG. 3B, the tip portions of the pair of hold pieces 526 extending from the end faces 525 of the insertion port 523 of the plug shell 520 are bent toward the lid member 524, so that the tip portions of the pair of the hold pieces 526 press the lid member 524 toward the end faces 525 of the insertion port 523. As a result, the lid member 524 is held on the end faces 525 of the insertion port 523. By the fixation method with crimping as described above, the lid member 524 is fixed onto the plug shell 520.

However, if the tip portions of the pair of hold pieces 526 are bent toward the lid member 524, a residual stress is generated in the bent sections. Such a residual stress is released if heat is applied to the bent sections. Therefore, if heat is applied to the pair of hold pieces 526 after the lid member 524 is fixed onto the plug shell 520 by bending the tip portions of the pair of hold pieces 526, the tip portions of the pair of hold pieces 526 will open due to the release of the residual stress and thermal expansion of the pair of hold pieces 526. Further, even if the pair of hold pieces 526 are cooled thereafter, the tip portions of the pair of hold pieces 526 do not completely return to the pre-heated state. Therefore, a gap is created between the lid member 524 and the tip portions of the pair of hold pieces 526, which causes a problem that the rocking movement (rattling) of the lid member 524 between the end faces 525 of the insertion port 523 and the pair of hold pieces 526 cannot be prevented.

SUMMARY OF THE INVENTION

The present invention is made in view of the above-described conventional problem, and the object thereof is to provide an electrical connector equipped with a plug shell, with which the rocking movement of a lid member that closes an insertion port into which a contact pin is inserted can be prevented, and a method for mounting the electrical connector.

The object as described above is achieved by the present invention of (1) to (9) below.

(1) An electrical connector equipped with a plug shell, the plug shell including an accommodation portion for accommodating a contact pin and a housing that holds the contact pin, an insertion port for inserting the contact pin and the housing into the accommodation portion, a lid member for closing the insertion port, and a hold mechanism for holding the lid member, wherein the hold mechanism is equipped with a pedestal, on which the lid member is placed, and a pair of hold pieces, which hold the lid member on the pedestal by pressing the lid member onto the pedestal, wherein the lid member has a central portion and end portions which are positioned on both sides of the central portion, and wherein the pair of hold pieces press the end portions of the lid member toward the pedestal, so that thereby a stress that urges the end portions of the lid member to become distant from the pedestal is generated in the lid member.

(2) The electrical connector according to the above-described (1), wherein the hold mechanism is further equipped with a protrusion portion which is formed on the pedestal, and wherein the protrusion portion pushes up the central portion of the lid member in a direction away from the pedestal.

(3) The electrical connector according to the above-described (1), wherein the lid member is equipped with a protrusion portion which is formed on a surface of the central portion facing the pedestal, and wherein the protrusion portion of the lid member makes contact with the pedestal, so that thereby the central portion of the lid member is pushed up in a direction away from the pedestal.

(4) The electrical connector according to the above-described (1), wherein the lid member has such a curved shape that, when the lid member is placed on the pedestal, the central portion is in contact with the pedestal and the end portions are distant from the pedestal, and wherein the pair of hold pieces press the end portions of the lid member, which are distant from the pedestal, toward the pedestal, so that thereby the stress that urges the end portions of the lid member to become distant from the pedestal is generated in the lid member.

(5) The electrical connector according to any one of the above-described (1) to (4), wherein each of the pair of hold pieces has an extending portion, which linearly extends along a thickness direction of the lid member from the pedestal, and a pressing portion, which extends from a tip of the extending portion so as to make contact with an upper face of the lid member, and wherein the pressing portion of the pair of hold pieces holds the lid member on the pedestal by pressing the lid member onto the pedestal.

(6) An electrical connector equipped with a plug shell, the plug shell including an accommodation portion for accommodating a contact pin and a housing that holds the contact pin, an insertion port for inserting the contact pin and the housing into the accommodation portion, a lid member for closing the insertion port, a hold mechanism equipped with a pedestal, on which the lid member is placed, and a pair of hold pieces, which hold the lid member on the pedestal by pressing the lid member onto the pedestal, and a viscous material which is positioned between the lid member and the pedestal of the hold mechanism.

(7) The electrical connector according to the above-described (6), wherein the viscous material is grease or adhesive.

(8) A method for mounting the electrical connector according to any one of the above-described (1) to (7), the method including a reflow step for fixing the electrical connector onto a circuit board.

Effect of the Invention

According to the present invention, a lid member can be firmly held on a pedestal. Therefore, even if heat is applied to a pair of hold pieces and the tip portions of the pair of hold pieces open, the rocking movement of the lid member can be prevented.

DETAILED DESCRIPTION

Figure 1:
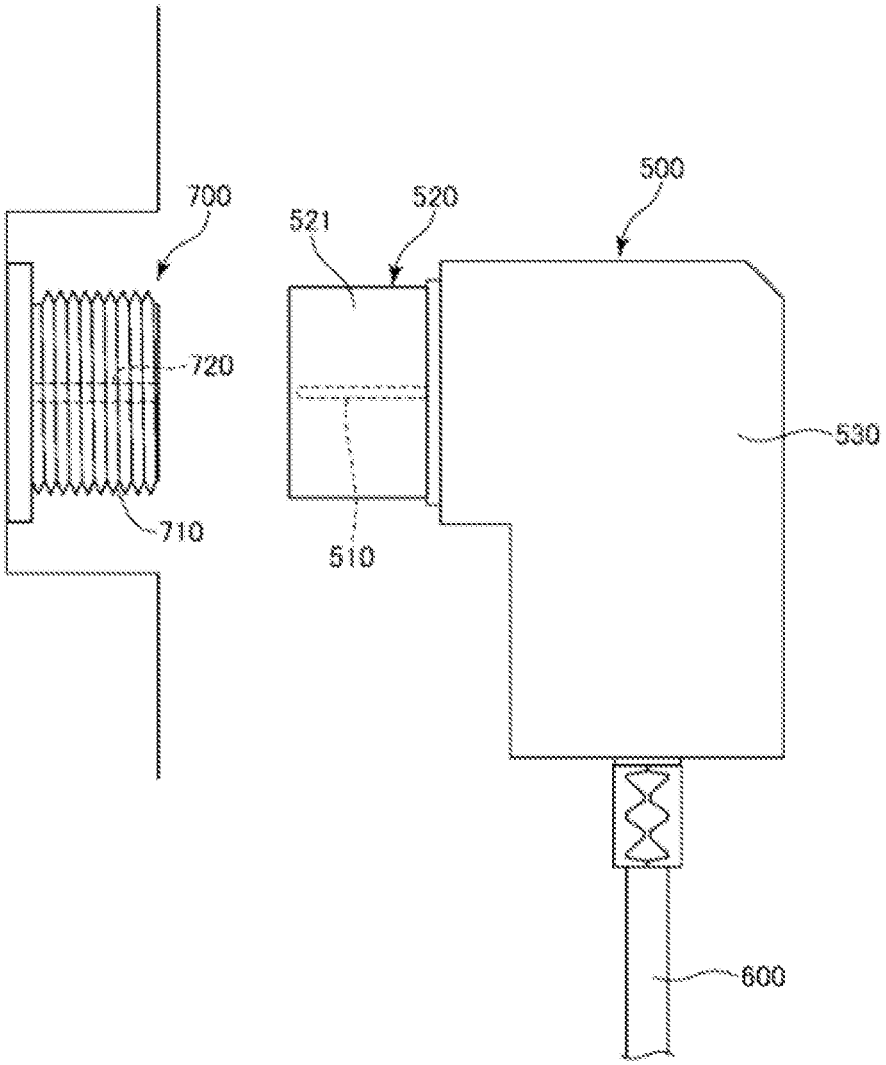
(Prior Art) FIG. 1
FIG. 1 is a diagram for explaining an overview of a connector of a conventional technology.
Figure 2:
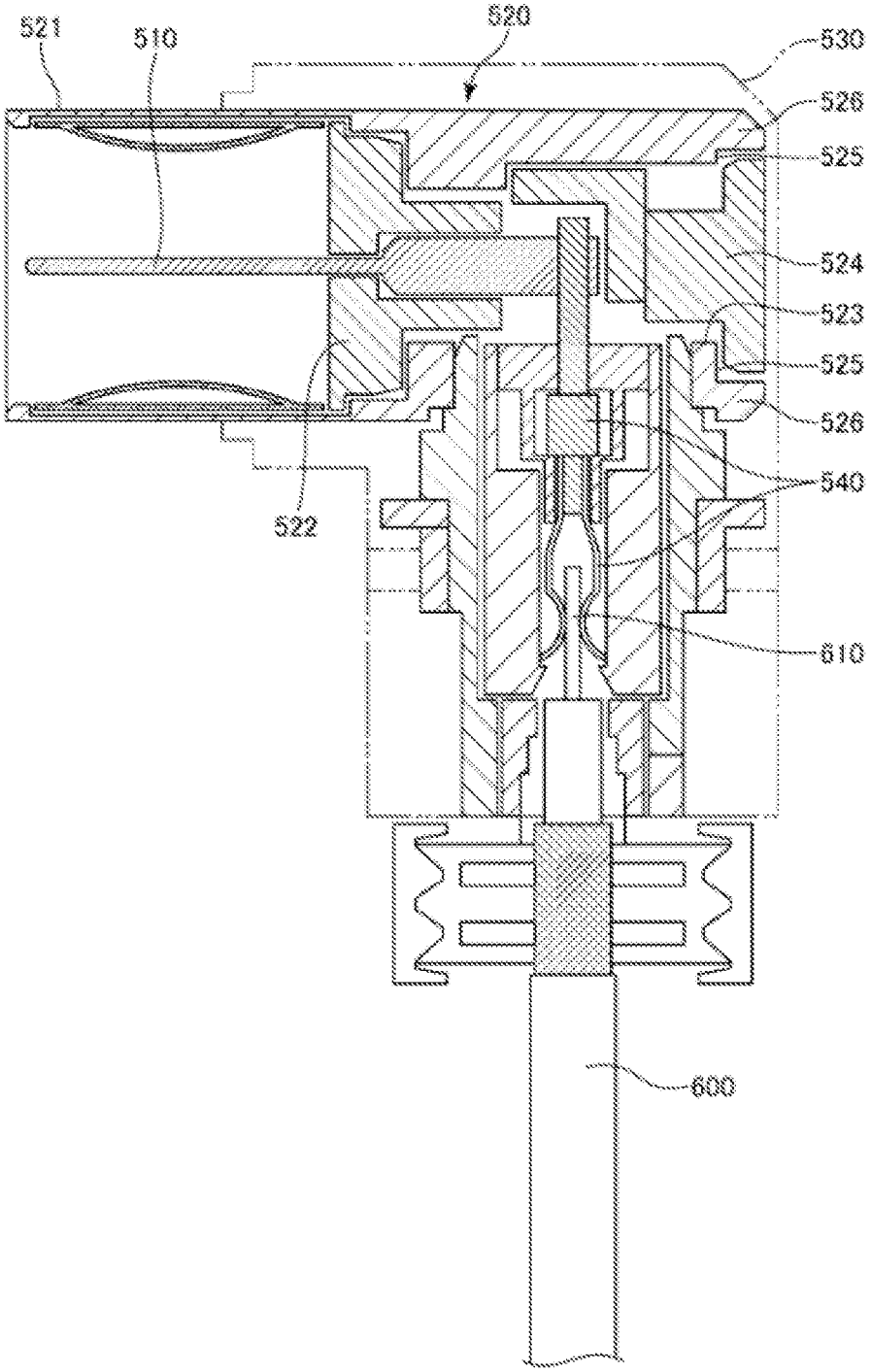
(Prior Art) FIG. 2
FIG. 2 is a cross-sectional view of the connector and a cable illustrated in FIG. 1.
Figure 3A:
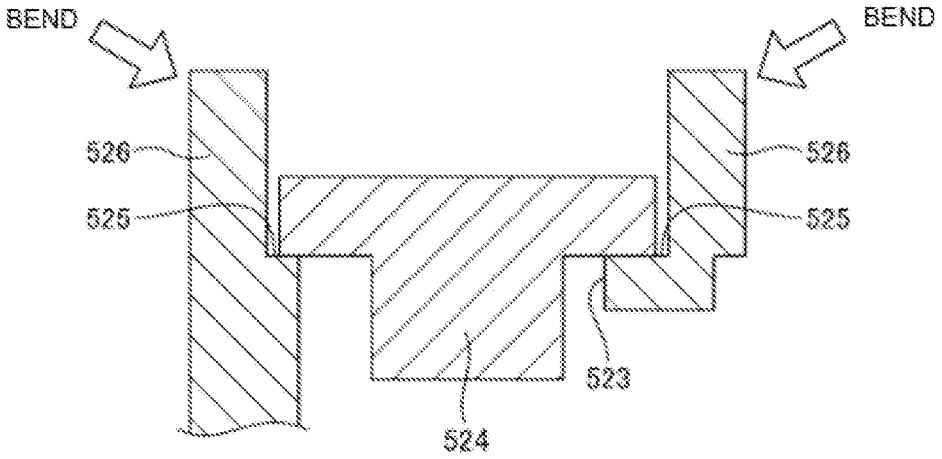
(Prior Art) FIG. 3A
FIGS. 3A and 3B are diagrams for explaining a fixation method with crimping.
Figure 3B:
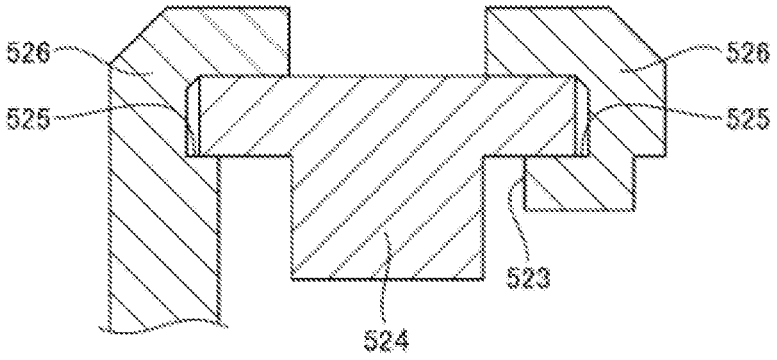
(Prior Art) FIG. 3B

Hereinafter, an electrical connector and a method for mounting the electrical connector of the present invention will be explained based on preferable embodiments illustrated in the accompanying drawings. Note that each of the drawings to be referred to below is a schematic diagram prepared for the explanation of the present invention. The dimensions (length, width, thickness, etc.) of each of the constituting elements illustrated in the drawings do not necessarily reflect the actual dimensions. Further, in each of the drawings, the same or corresponding elements are assigned with the same reference numerals. In the following explanations, the positive direction of the Z axis in each of the drawings is referred to as the "tip side", the negative direction of the Z axis is referred to as the "base end side", the positive direction of the Y axis is referred to as the "front side", the negative direction of the Y axis is referred to as the "rear side", the positive direction of the X axis is referred to as the "upper side", and the negative direction of the X axis is referred to as the "lower side".

First Embodiment

Figure 4:
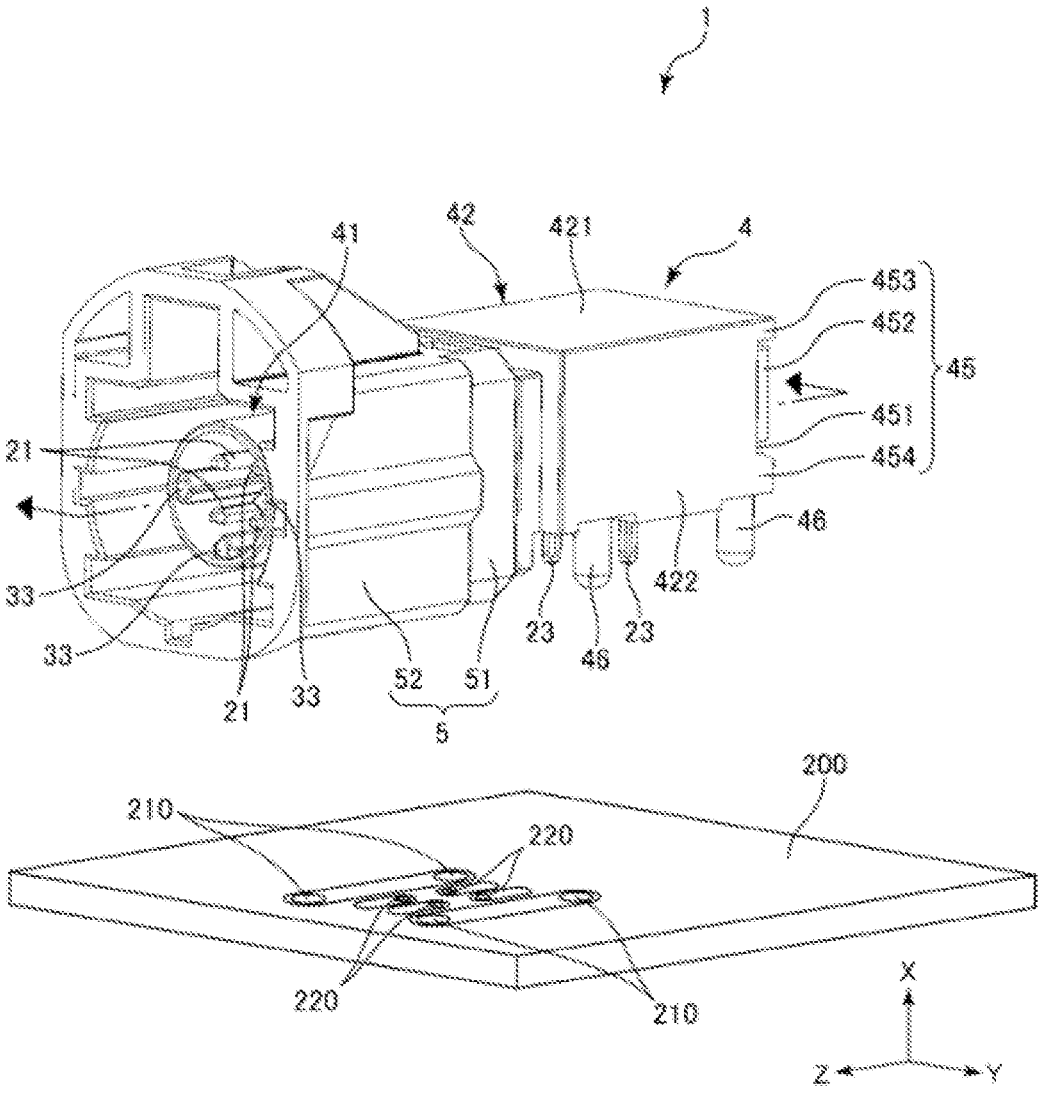
FIG. 4 is a perspective view illustrating an electrical connector and a circuit board on which the electrical connector is mounted according to the first embodiment of the present invention.
Figure 5:
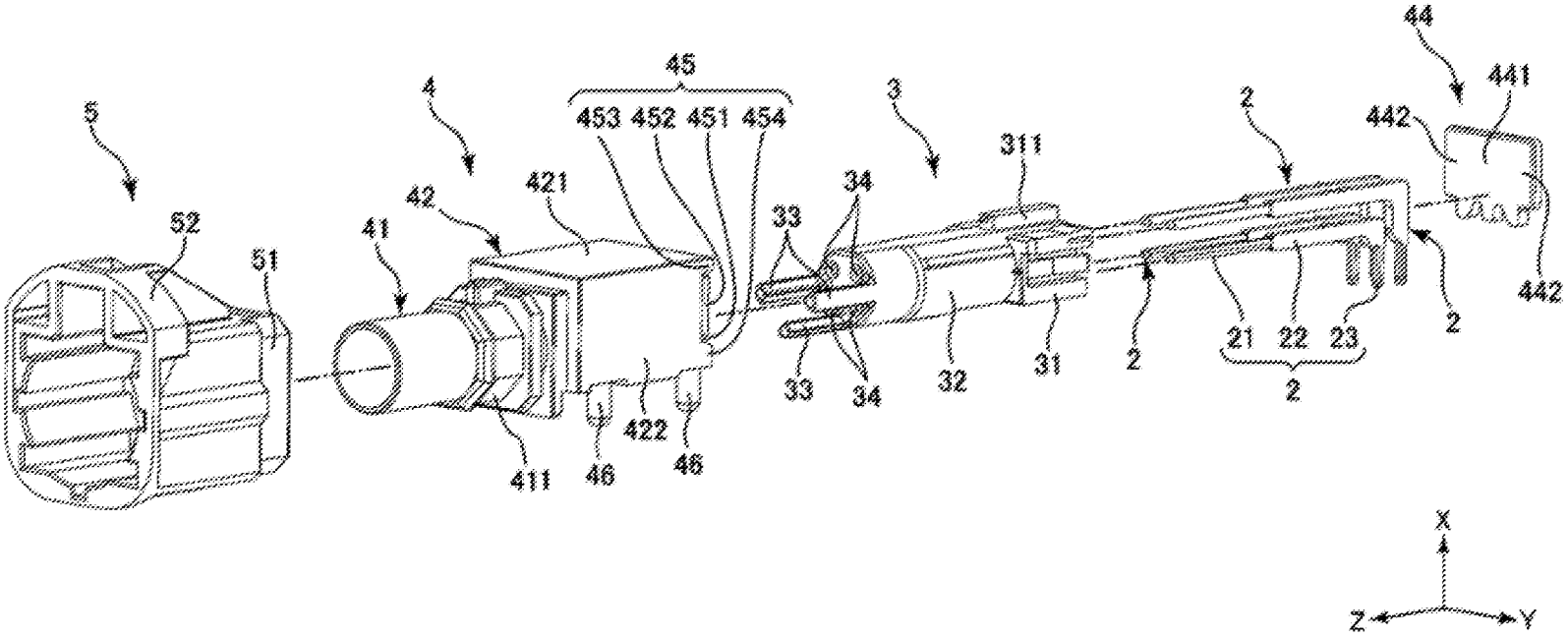
FIG. 5 is an exploded perspective view of the electrical connector illustrated in FIG. 4.
Figure 6:
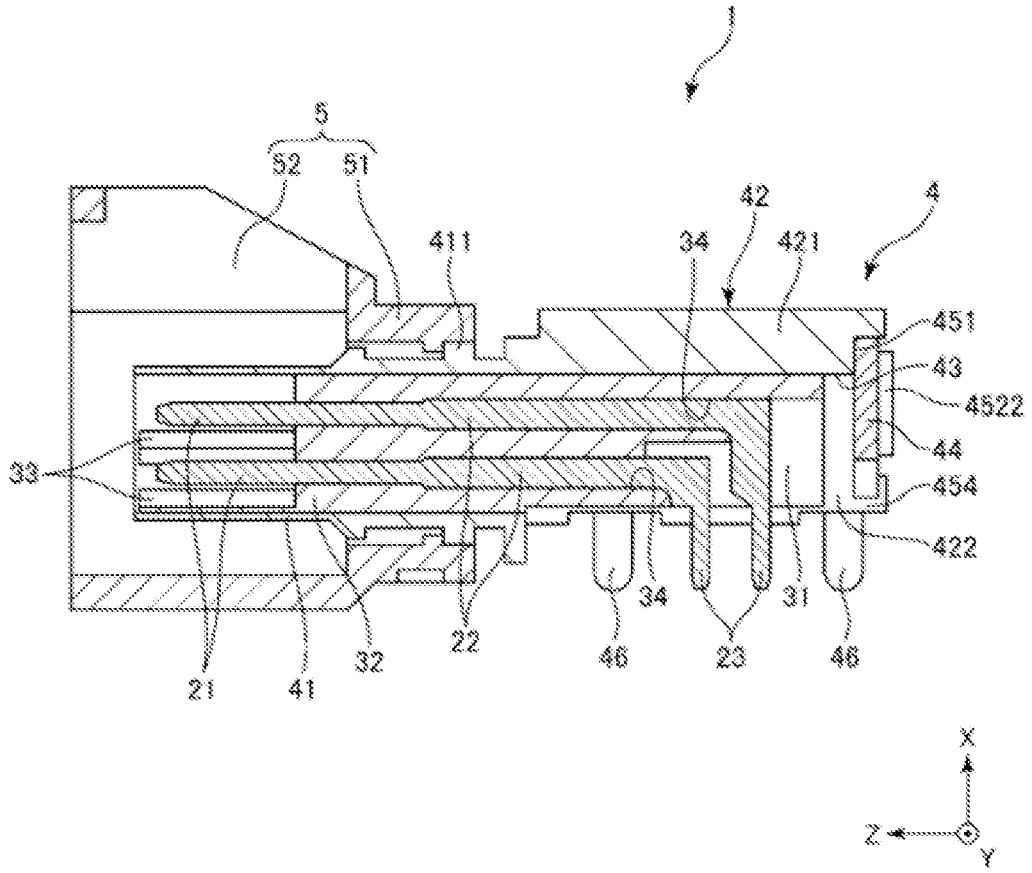
FIG. 6 is a cross-sectional view of the electrical connector illustrated in FIG. 4 in a cut cross section including contact pins.
Figure 7:
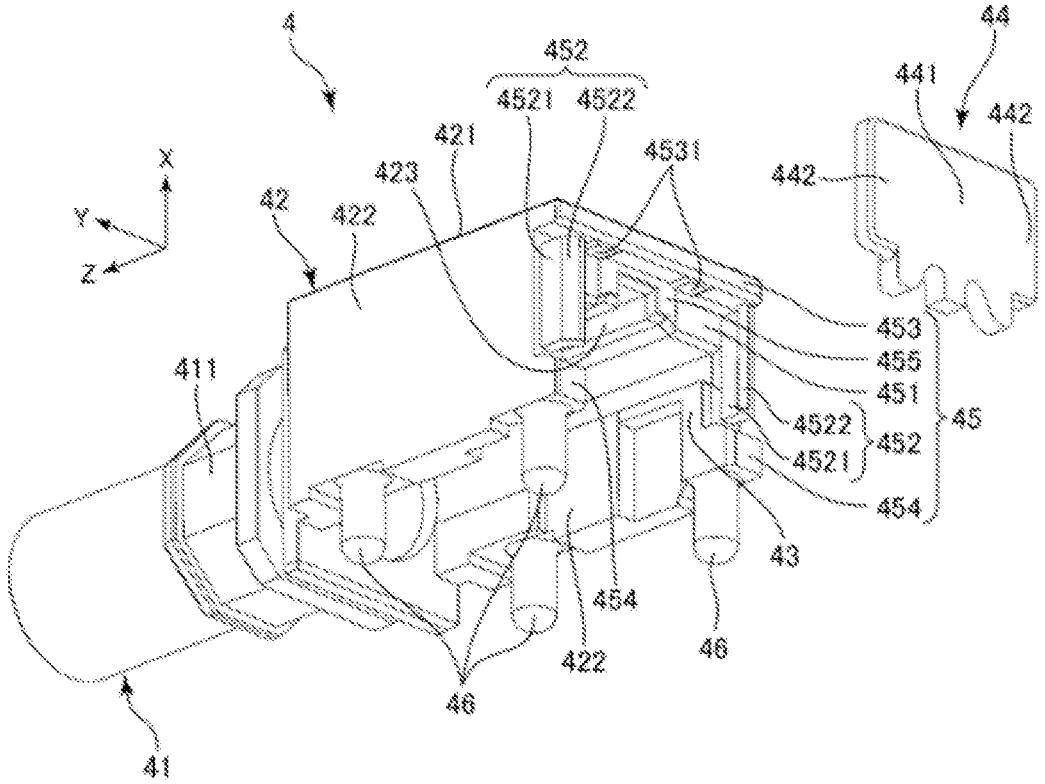
FIG. 7 is an exploded perspective view of a plug shell illustrated in FIG. 4.
Figure 8A:
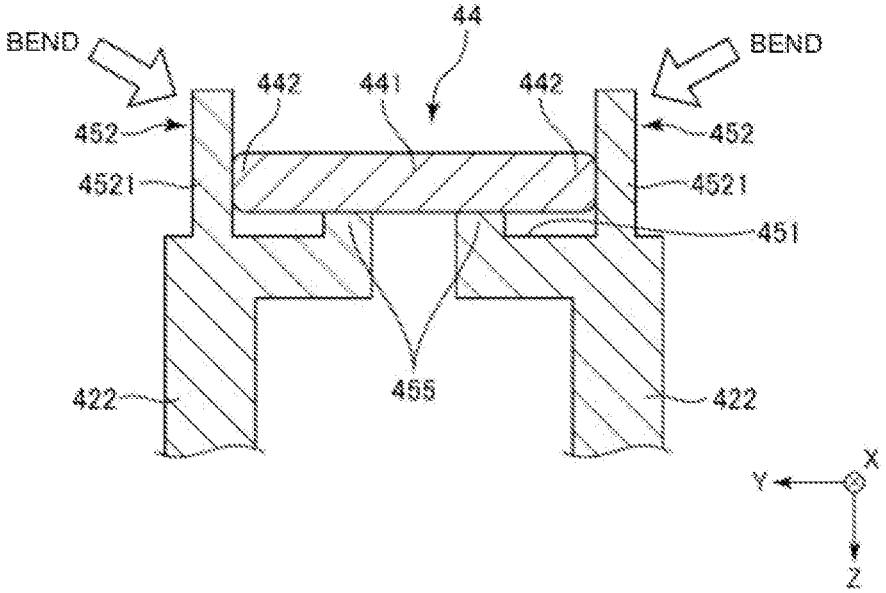
FIGS. 8A and 8B are diagrams for a detailed description of the hold state of a lid member.
Figure 8B:
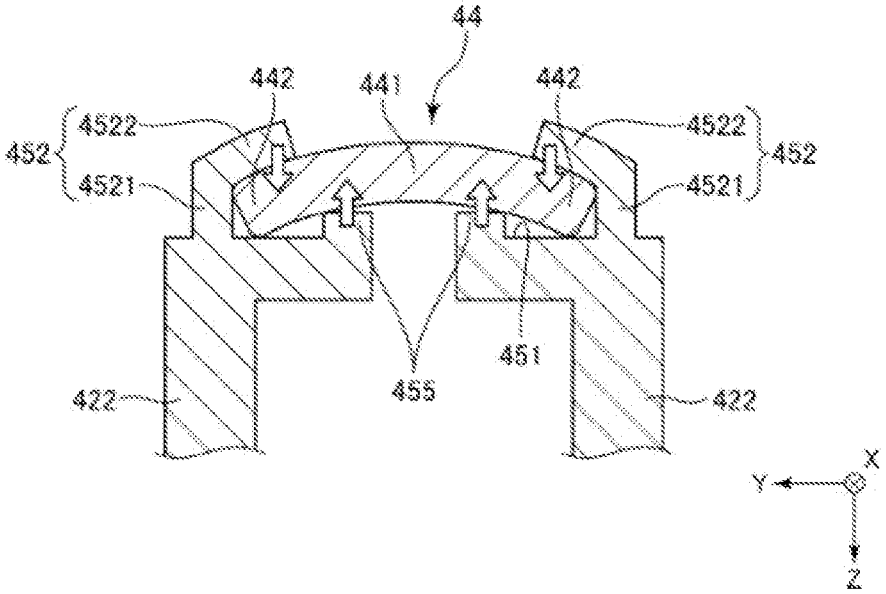

First, with reference to FIG. 4 to FIGS. 8A and 8B, the electrical connector according to the first embodiment of the present invention will be described in detail. FIG. 4 is a perspective view illustrating the electrical connector and a circuit board on which the electrical connector is mounted according to the first embodiment of the present invention. FIG. 5 is an exploded perspective view of the electrical connector illustrated in FIG. 4. FIG. 6 is a cross-sectional view of the electrical connector illustrated in FIG. 4 in a cut cross section including contact pins. FIG. 7 is an exploded perspective view of a plug shell illustrated in FIG. 4. FIGS. 8A and 8B are a diagram for a detailed description of the hold state of a lid member.

The electrical connector 1 according to the first embodiment of the present invention illustrated in FIG. 4 is mounted on the circuit board 200 which is installed in a given device. If a counterpart connector attached to the tip of an extraneous cable, which is not illustrated in the drawings, is inserted to the connector 1 from the tip (+Z direction) side of the electrical connector 1, an electrical connection will be provided between the circuit board 200 on which the electrical connector 1 is mounted and the extraneous cable. Typically, the connector 1 is an HSD (High Speed Data) connector or a FAKRA (Fachkreis Automobitechnik) connector to be used for connecting an in-vehicle device, such as a car navigation system, car audio, in-vehicle camera, in-vehicle GPS, in-vehicle TV, or in-vehicle radio, to an ECU (Electronic Control Unit) which controls operation of an automobile. The electrical connector 1 may be a coaxial cable connector with one contact pin to provide a coaxial connection or may be a multi-pin connector to provide a connection of multiple contact pins. Hereinafter, an explanation will be given on the assumption that the electrical connector 1 is a four-pin connector with four contact pins to provide a four-pin connection.

The circuit board 200 is equipped with the four ground terminals 210, to which the four ground pins 46 of the electrical connector 1 are inserted, and the four contact pin terminals 220, to which the terminal portions 23 of the four contact pins 2 of the electrical connector 1 are inserted. The electrical connector 1 is attached to the circuit board 200 such that the four ground pins 46 and the terminal portions 23 of the four contact pins 2 of the electrical connector 1 are inserted to the four ground terminals 210 and the four contact pin terminals 220 of the circuit board 200, respectively. Thereafter, the reflow for fixing the electrical connector 1 onto the circuit board 200 is performed, and thus the electrical connector 1 will be mounted on the circuit board 200.

As illustrated in FIG. 4 to FIG. 6, the electrical connector 1 includes the four contact pins 2, which make contact with the terminals of a counterpart connector, the insulating housing 3, which holds the four contact pins 2 in a state of being insulated from each other, the metal plug shell 4 having the cylindrical portion 41, which is to be engaged with the counterpart connector, and the accommodation portion 42, which is for accommodating the four contact pins 2 and the housing 3, and the cover 5 attached to the tip side of the plug shell 4.

Each of the contact pins 2 is configured of a conductive material, such as a copper alloy, and has a function of making contact with the corresponding terminal of the counterpart connector to provide an electrical connection between the counterpart connector and the electrical connector 1 when the counterpart connector is inserted to the electrical connector 1 from the tip side. Each of the contact pins 2 includes the contact point portion 21, which makes contact with the corresponding terminal of the counterpart connector, the extending portion 22, which extends from the contact point portion 21 toward the base end side, and the terminal portion 23, which is to be connected to the corresponding terminal of the circuit board 200. Further, the terminal portion 23 extends toward the downward direction (the −X direction), and each of the contact pins 2 has an L-shape overall.

The contact point portion 21 is a cylindrical section that makes contact with the corresponding terminal of the counterpart connector when the counterpart connector is inserted to the electrical connector 1 from the tip side. If the electrical connector 1 is turned into the engaged state with the counterpart connector, the contact point portion 21 makes contact with the corresponding terminal of the counterpart connector, so that an electrical connection between the counterpart connector and the electrical connector 1 is provided. The extending portion 22 is an L-shaped section that extends horizontally from the base end of the contact point portion 21 to the base end side (the −Z direction) and then extends downwardly (the −X direction). The horizontally extending sections of the extending portions 22 of the four contact pins 2 are embedded in the housing 3, so that the four contact pins 2 are fixedly held by the housing 3 in the state of being insulated from each other. The terminal portions 23 extend downwardly from the lower end portions of the downwardly extending sections of the extending portions 22. As illustrated in FIG. 4 and FIG. 6, the lower end portions of the terminal portions 23 are exposed out of the housing 3. The terminal portions 23 of the four contact pins 2 are respectively inserted and connected to the four contact pin terminals 220 of the circuit board 200.

The housing 3 is configured of an insulating material such as a resin material and has a function of holding the four contact pins 2 in the state of being insulated from each other. Further, the housing 3 is accommodated inside the plug shell 4 in the state where the four contact pins 2 are held. The housing 3 is a long member having an outer shape corresponding to the shape of the inner face of the plug shell 4. The housing 3 has the base portion 31, the cylindrical portion 32 protruding from the tip of the base portion 31 to the tip side, the three positioning portions 33 protruding from the cylindrical portion 32 to the tip side, and the four press-fit holes 34 into which four contact pins 2 are respectively press-fitted.

The base portion 31 is a box-shaped section and, as illustrated in FIG. 6, the base portion 31 is positioned inside the accommodation portion 42 of the plug shell 4 when the housing 3 is accommodated inside the plug shell 4. In the state where the four contact pins 2 are respectively press-fitted into the four press-fit holes 34 and held by the housing 3, the terminal portions 23 of the four contact pins 2 protrude downwardly from the base portion 31. Further, as illustrated in FIG. 5, the base portion 31 has the engagement convex portion 311 formed on the upper face of the base portion 31. The engagement convex portion 311 is a convex portion extending linearly along the direction in which the electrical connector 1 is inserted or pulled out (the Z direction) on the upper face of the base portion 31, so as to be engaged with the engagement groove 423 (see FIG. 7) formed on the inner face of the accommodation portion 42 of the plug shell 4.

The housing 3 is fixed and accommodated inside the plug shell 4 by sliding and inserting the housing 3 into the plug shell 4 so that the engagement convex portion 311 is engaged with the engagement groove 423 formed on the inner face of the accommodation portion 42 of the plug shell 4. Therefore, the engagement convex portion 311 has a function of guiding the housing 3 to be inserted into the plug shell 4 and positioning the housing 3 inside the plug shell 4.

Returning to FIG. 5, the cylindrical portion 32 is a cylindrical section extending from the tip of the base portion 31. Further, as illustrated in FIG. 6, in the state where the electrical connector 1 is assembled, the base end portion of the cylindrical portion 32 is positioned inside the accommodation portion 42 of the plug shell 4, and the tip portion of the cylindrical portion 32 is positioned inside the cylindrical portion 41 of the plug shell 4.

Returning to FIG. 5, the three positioning portions 33 are sections which are distant from each other and extend from the tip face of the cylindrical portion 32 to the tip side. In the state where the electrical connector 1 is assembled, the three positioning portions 33 are in contact with the inner face of the cylindrical portion 41 of the plug shell 4, so that the rocking movement of cylindrical portion 32 inside the cylindrical portion 41 of the plug shell 4 is prevented.

The four press-fit holes 34 are through holes penetrating the base portion 31 and the cylindrical portion 32 along the direction in which the electrical connector 1 is inserted and pulled out (the Z direction). The contact point portions 21 of the four contact pins 2 are respectively press-fitted into the four press-fit holes 34 from the base end side of the base portion 31, and the contact point portions 21 of the four contact pins 2 are made to protrude from the cylindrical portion 32 to the tip side, and, further, the base end sections and the extending portions 22 of the contact point portions 21 of the four contact pins 2 are embedded into the base portion 31 and the cylindrical portion 32, so that the four contact pins 2 are held by the housing 3 in the state of being insulated from each other.

When assembling the electrical connector 1, firstly, the contact point portions 21 of the four contact pins 2 are respectively press-fitted into the four press-fit holes 34 of the housing 3 from the base end side of the base portion 31, so that the four contact pins 2 are held by the housing 3. Thereafter, the housing 3 being in the state of holding the four contact pins 2 is inserted into the plug shell 4.

The plug shell 4 is configured of a conductive material and has a function of accommodating the four contact pins 2 and the housing 3 therein and shielding the four contact pins 2 from being affected by external electromagnetic waves so as to improve the noise immunity of the electrical connector 1. As the conductive material configuring the plug shell 4, a metal material or an alloy of metal materials can be used. Typically, from the standpoint of cost and ease of processing, a zinc alloy is used as the conductive material configuring the plug shell 4. The method for forming the plug shell 4 is not particularly limited, but, typically, the plug shell 4 can be formed by a casting method, in which a conductive material melted by heating is poured into a metal mold and then the conductive material is solidified by cooling.

As illustrated in FIG. 7, the plug shell 4 includes the cylindrical portion 41 to be engaged with a counterpart connector, the accommodation portion 42 which is formed so as to communicate with the cylindrical portion 41, the insertion port 43 which is formed in the base end side section of the accommodation portion 42 so as to allow the contact pins 2 and the housing 3 to be inserted into the accommodation portion 42, the lid member 44 which closes the insertion port 43, the hold mechanism 45 for holding the lid member 44, and the four ground pins 46 which protrude downwardly from the lower end face of the accommodation portion 42.

The cylindrical portion 41 is a hollow circular cylindrical portion. As illustrated in FIG. 6, the tip portion of the cylindrical portion 32 of the housing 3 is positioned inside the cylindrical portion 41. Further, inside the cylindrical portion 41, the contact point portions 21 of the four contact pins 2 extend from the tip face of the cylindrical portion 32 of the housing 3 toward the tip side in a state of being distant from the inner face of the cylindrical portion 41. Further, in this state, the contact point portions 21 of the four contact pins 2 are distant from each other. When a counterpart connector is inserted to the electrical connector 1 from the tip side, the cylindrical portion 41 of the plug shell 4 is engaged with the corresponding cylindrical portion of the counterpart connector.

The cylindrical portion 41 includes the attachment portion 411 for the cover 5 to be attached. The attachment portion 411 is formed so as to protrude outwardly from a base end side section on the outer peripheral face of the cylindrical portion 41. By engaging the engagement portion 51 of the cover 5 with the attachment portion 411 of the cylindrical portion 41, the cover 5 is attached to the plug shell 4.

The accommodation portion 42 is integrally formed on the base end side of the cylindrical portion 41 so as to communicate with the cylindrical portion 41. The accommodation portion 42 has a function of internally accommodating the housing 3, which holds the four contact pins 2. As illustrated in FIG. 7, the accommodation portion 42 is formed with the upper plate 421 and the pair of wall portions 422 extending downwardly from the end portions on the rear side and front side of the upper plate 421 and is open toward the downward direction (the −X direction) and the base end direction (the −Z direction). The internal space of the accommodation portion 42 is defined by the upper plate 421 and the pair of wall portions 422 of the accommodation portion 42, and the housing 3 which holds the four contact pins 2 is accommodated inside the internal space. Further, the engagement groove 423 is formed on the inner face of the upper plate 421, which defines the accommodation portion 42. The engagement groove 423 has a shape corresponding to the engagement convex portion 311, which is formed on the base portion 31 of the housing 3. The housing 3 is fixed and accommodated inside the plug shell 4 by sliding and inserting the housing 3 into the internal space of the plug shell 4 so that the engagement convex portion 311 of the housing 3 is engaged with the engagement groove 423 of the plug shell 4.

The insertion port 43 is a rectangular opening formed in the base end side section of the accommodation portion 42 and is defined by the base end side sections of the upper plate 421 and the pair of wall portions 422 of the accommodation portion 42. When assembling the electrical connector 1, the housing 3 being in the state of holding the four contact pins 2 is inserted into the plug shell 4 via the insertion port 43.

The lid member 44 is configured of a conductive material and is a plate-shaped member having the central portion 441 with respect to the width direction (the Y direction) and the pair of end portions 442 positioned on both sides of the central portion 441 in the width direction. Typically, the lid member 44 is configured of a metal material. In the present embodiment, the lid member 44 has a flat plate shape of which the central portion 441 and the pair of end portions 442 are in the same plane in its natural state where no pressing force is applied to the lid member 44. That is, in its natural state where no pressing force is applied to the lid member 44, the lid member 44 is not curved or bent.

After the housing 3, which is in a state of holding the four contact pins 2, is inserted into the plug shell 4 via the insertion port 43, and the four contact pins 2 and the housing 3 are accommodated inside the plug shell 4, the insertion port 43 is closed with the lid member 44. In this way, in order to enable the housing 3, which is in the state of holding the four contact pins 2 inside the plug shell 4, to be inserted when assembling the electrical connector 1, the insertion port 43 needs to be formed in the base end side section of the accommodation portion 42. On the other hand, in order to improve the noise immunity of the electrical connector 1, it is necessary that the insertion port 43, which is positioned on the base end side (the −Z direction side) of the four contact pins 2, is closed with a conductive member in the state where the electrical connector 1 is assembled. For such a reason, the lid member 44 is used to close the insertion port 43, so as to improve the noise immunity of the electrical connector 1.

The hold mechanism 45 has a function of holding the lid member 44 so as to close the insertion port 43. As illustrated in FIG. 7, the hold mechanism 45 is equipped with the pedestal 451 for placing the lid member 44, the pair of hold pieces 452 that hold the lid member 44 by pressing the lid member 44 onto the pedestal 451, the upper-side support portion 453 that supports the lid member 44 on the pedestal 451 from the upper side, the pair of lower-side support portions 454 that support the lid member 44 on the pedestal 451 from the lower side, and the protrusion portions 455 formed on the pedestal 451.

The pedestal 451 is a section on which the lid member 44 is placed. In the form illustrated in the drawings, the pedestal 451 is the base end face of the upper plate 421 and the pair of wall portions 422 of the accommodation portion 42, which defines the insertion port 43, the present invention is not limited as such. For example, such a form in which one or more plate-shaped portions extending toward the inner side of the plug shell 4 are formed on the inner face of the accommodation portion 42 of the plug shell 4 so that the plate-shaped portions function as the pedestal 451 is also within the range of the present invention.

The pair of hold pieces 452 are plate-shaped sections respectively extending from both of the width direction (the Y direction) ends of the pedestal 451 toward the base end side. The width (the length in the X direction) of each of the pair of hold pieces 452 is approximately equal to the length in the X direction of the lid member 44, and the height (the length in the Z direction) of each of the pair of hold pieces 452 is greater than the thickness of the lid member 44. The pair of hold pieces 452 are formed on the pedestal 451 so that the lid member 44, which is placed on the pedestal 451, is nipped therebetween in the state where the electrical connector 1 is assembled. Each of the pair of hold pieces 452 has the extending portion 4521, which linearly extends from the pedestal 451 along the thickness direction (the Z direction) of the lid member 44, and the pressing portion 4522, which extends from the tip of the extending portion 4521 so as to make contact with the upper face of the lid member 44. The distance between the inner faces of the extending portions 4521 of the pair of hold pieces 452 is approximately equal to the width (the length in the Y direction) of the lid member 44. Therefore, the lid member 44 is placed on the pedestal 451 is positioned between the extending portions 4521 of the pair of hold pieces 452. The pair of pressing portions 4522 hold the lid member 44 on the pedestal 451 by pressing the pair of end portions 442 of the lid member 44, which is placed on the pedestal 451, toward the pedestal 451.

In stages before the electrical connector 1 is assembled, each of the pair of hold pieces 452 has the extending portion 4521 but does not have the pressing portion 4522. When assembling the electrical connector 1, a crimping operation for holding the lid member 44 on the pedestal 451 is performed on each of the pair of hold pieces 452, and thus the pressing portion 4522 is formed. In the crimping operation, each of the tip portions of the extending portions 4521 of the pair of hold pieces 452, which are positioned on both sides of the lid member 44, is bent toward the central portion 441 (the inner sides) of the lid member 44 so as to press the pair of end portions 442 of the lid member 44 toward the pedestal 451. By such a crimping operation, the pressing portion 4522 is formed at each of the tip portions of the extending portions 4521 of the pair of hold pieces 452. By performing such a crimping operation, the lid member 44 is held on the pedestal 451 by the pair of hold pieces 452.

The upper-side support portion 453 is a flat plate-shaped portion extending from the upward direction (the +Z direction) end portion of the pedestal 451 toward the base end side. The upper-side support portion 453 has the pair of support protrusions 4531 formed on the inner face thereof. When the lid member 44 is placed on the pedestal 451, the pair of support protrusions 4531 of the upper-side support portion 453 make contact with the upper-side end face of the lid member 44 so as to support the lid member 44 from the upper side. The lower-side support portions 454 are the pair of block-shaped portions extending from the sections, which are lower (the −X direction) than the parts of the pedestal 451 where the pair of hold pieces 452 are formed, toward the base end side. When the lid member 44 is placed on the pedestal 451, the lower-side support portions 454 makes contact with the lower-side end face of the lid member 44 so as to support the lid member 44 from the lower side.

The protrusion portions 455 is a portion below (the −X direction) from the portion where the upper support portion 453 of the part of the pedestal 451 is formed, and when the lid 44 is placed on the pedestal 451, the protrusion portions 455 are formed so as to project toward the base end side from the portion facing the central portion 441. The protrusion portions 455 are sections formed to push up the central portion 441 of the lid member 44 in a direction away from the pedestal 451 when the pair of pressing portions 4522 push the pair of end portions 442 of the lid member 44 toward the pedestal 451. With the protrusion portions 455 formed on the pedestal 451 as described above, the lid member 44 can consequently be held on the pedestal 451 in a state where the lid member 44 is curved and deformed from its natural flat plate-shaped state. Hereinafter, with reference to FIGS. 8A and 8B, a detailed description will be given of how it is possible to hold the lid member 44 on the pedestal 451 in a state where the lid member 44 is curved and deformed from its natural state. Note that, in FIGS. 8A and 8B, in order to clearly illustrate the hold mechanism 45 of the plug shell 4 and the lid member 44, the members other than the pedestal 451, the pair of hold pieces 452, and the protrusion portions 455 of the hold mechanism 45 as well as the lid member 44 are omitted.

When assembling the electrical connector 1, the housing 3, which holds the contact pins 2, is inserted into the plug shell 4 via the insertion port 43 of the plug shell 4, and the contact pins 2 and the housing 3 are accommodated inside the accommodation portion 42 of the plug shell 4. Next, the lid member 44 is placed on the pedestal 451. Here, the pressing portions 4522 are not formed in the pair of hold pieces 452 of the hold mechanism 45.

In FIG. 8A, the cross-sectional view of the pedestal 451, the pair of hold pieces 452, the protrusion portions 455, and the lid member 44 in the above-described state is schematically illustrated. As illustrated in FIG. 8A, the central portion 441 of the lid member 44 makes contact with the protrusion portions 455 formed on the pedestal 451. Therefore, in stages before a crimping operation is performed, only the central portion 441 of the lid member 44 is in contact with the pedestal 451, and the pair of end portions 442 of the lid member 44 are distant from the pedestal 451.

In this state, the crimping operation is performed on the pair of the hold pieces 452, so that the pressing portions 4522 that presses the pair of end portions 442 of the lid member 44 toward the pedestal 451 will be formed in the pair of hold pieces 452, respectively. In FIG. 8B, the cross-sectional view of the pedestal 451, the pair of hold pieces 452, the protrusion portions 455, and the lid member 44 after the crimping operation is performed is schematically illustrated. As illustrated in FIG. 8B, the pair of end portions 442 of the placed lid member 44 are pushed down toward the pedestal 451 by the pressing force applied from the pressing portions 4522 of the pair of hold pieces 452. In this state, the shape of the lid member 44 is curved and deformed from the flat plate shape to an upward-convex dome shape. More specifically, as indicated by the arrows in FIG. 8B, the central portion 441 of the lid member 44 is pushed up in a direction relatively away from the pedestal 451 by the protrusion portions 455 formed on the pedestal 451, and the pair of end portions 442 of the lid member 44 are pushed down to the pedestal 451 side relative to the central portion 441 by the pressing portions 4522 of the pair of hold pieces 452. As a result, a pressing force in a direction away from the pedestal 451 is applied to the central portion 441 of the lid member 44 whereas a pressing force in a direction toward the pedestal 451 is applied to the pair of end portions 442 of the lid member 44. Accordingly, the lid member 44 is held on the pedestal 451 by the pair of hold pieces 452 in a state where the pair of end portions 442 of the lid member 44 are curved and deformed toward the pedestal 451.

In this way, the pressing portions 4522 of the pair of hold pieces 452 press the pair of end portions 442 of the lid member 44 toward the pedestal 451, and, accordingly, the lid member 44 is held on the pedestal 451 in a state of being curved and deformed from its natural state. Therefore, in the state where the lid member 44 is held on the pedestal 451, a stress that urges to return to its natural state (the flat plate shape) to make the pair of end portions 442 of the lid member 44 become distant from the pedestal 451 is generated in the lid member 44 by the elasticity of the conductive material configuring the lid member 44. Since such an internal stress as described above is generated in the lid member 44, even if the pair of hold pieces 452 are heated by heat, etc., which is generated in a reflow operation or the like performed for mounting the electrical connector 1 onto the circuit board 200 so that the pair of hold pieces 452 are deformed so as to open the pressing portions 4522, the pair of end portions 442 of the lid member 44 are elastically restored by the stress generated in the lid member 44 so as to follow the deformation of the pressing portions 4522 of the pair of hold pieces 452. Therefore, in the present embodiment, even if the pair of hold pieces 452 are heated and deformed so as to open the pressing portions 4522 of the pair of hold pieces 452, no distance is generated between the pressing portions 4522 of the pair of hold pieces 452 and the lid member 44. Therefore, the lid member 44 can be firmly held on the pedestal 451, so that the rocking movement of the lid member 44 on the pedestal 451 can be securely prevented.

Returning to FIG. 7, each of the four ground pins 46 is a cylindrical section that extends downwardly from the lower-side end face of each of the pair of wall portions 422 of the accommodation portion 42. The four ground pins 46 are inserted and connected to the four ground terminals 210 of the circuit board 200, respectively, when the electrical connector 1 is mounted on the circuit board 200.

As illustrated in FIG. 4 to FIG. 6, the cover 5 is a hollow cylindrical member configured of an insulating material, such as a resin material, and is attached to the attachment portion 411 of the cylindrical portion 41 of the plug shell 4. The cover 5 has a function of guiding a counterpart connector to be engaged with the cylindrical portion 41 of the plug shell 4 and supporting the counterpart connector being engaged with the cylindrical portion 41 of the plug shell 4. The cover 5 has the engagement portion 51, which is to be engaged with the attachment portion 411 of the cylindrical portion 41 of the plug shell 4, and the reception portion 52, which is formed so as to communicate with the engagement portion 51.

The engagement portion 51 is a section to be engaged with the attachment portion 411 of the cylindrical portion 41 of the plug shell 4. When the engagement portion 51 is engaged with the attachment portion 411 of the cylindrical portion 41 of the plug shell 4, the cover 5 is attached to the plug shell 4. The reception portion 52 is a section that accepts the tip portion of a counterpart connector to be connected to the electrical connector 1. As illustrated in FIG. 6, the tip section of the cylindrical portion 41 of the plug shell 4 and the tip portions of the contact point portions 21 of the four contact pins 2 are positioned inside the reception portion 52. When the tip portion of a counterpart connector is inserted into the reception portion 52 from the tip side, the insertion of the counterpart connector is guided so that the counterpart connector will be engaged with the cylindrical portion 41 of the plug shell 4.

The above-described electrical connector 1 is mounted on the circuit board 200 by the method for mounting the electrical connector 1 of the present invention, which will be described in detail below. Specifically, first, the electrical connector 1 is attached to the circuit board 200 such that the four ground pins 46 and the terminal portions 23 of the four contact pins 2 of the electrical connector 1 are inserted to the four ground terminals 210 and the four contact pin terminals 220 of the circuit board 200, respectively. Thereafter, the reflow for fixing the electrical connector 1 onto the circuit board 200 is performed, and thus the electrical connector 1 will be mounted on the circuit board 200. In the state where the electrical connector 1 is mounted on the circuit board 200, only the section on the base end side relative to the cover 5 of the electrical connector 1 is positioned on the circuit board 200, and the cover 5 of the electrical connector 1 protrudes outwardly from the circuit board 200.

As described in detail so far, in the plug shell 4 of the present embodiment, the lid member 44 for closing the insertion port 43 is held on the pedestal 451 in a state of being curved and deformed from its natural state, or more specifically, in a state where the pair of end portions 442 of the lid member 44 are curved and deformed toward the pedestal 451. Therefore, in the state where the lid member 44 is held on the pedestal 451, a stress that urges the pair of end portions 442 of the lid member 44 to become distant from the pedestal 451 is generated in the lid member 44. Therefore, even if the pair of hold pieces 452 are heated by heat, etc., which is generated in a reflow step or the like performed for mounting the electrical connector 1 onto the circuit board 200 so that the pair of hold pieces 452 are deformed so as to open the pressing portions 4522, the pair of end portions 442 of the lid member 44 are elastically restored even more so as to follow the deformation of the pressing portions 4522 of the pair of hold pieces 452, and thus no separation is generated between the pressing portions 4522 of the pair of hold pieces 452 and the lid member 44. Therefore, the lid member 44 can be firmly held on the pedestal 451, so that the rocking movement of the lid member 44 on the pedestal 451 can be securely prevented.

Second Embodiment

Figure 9:
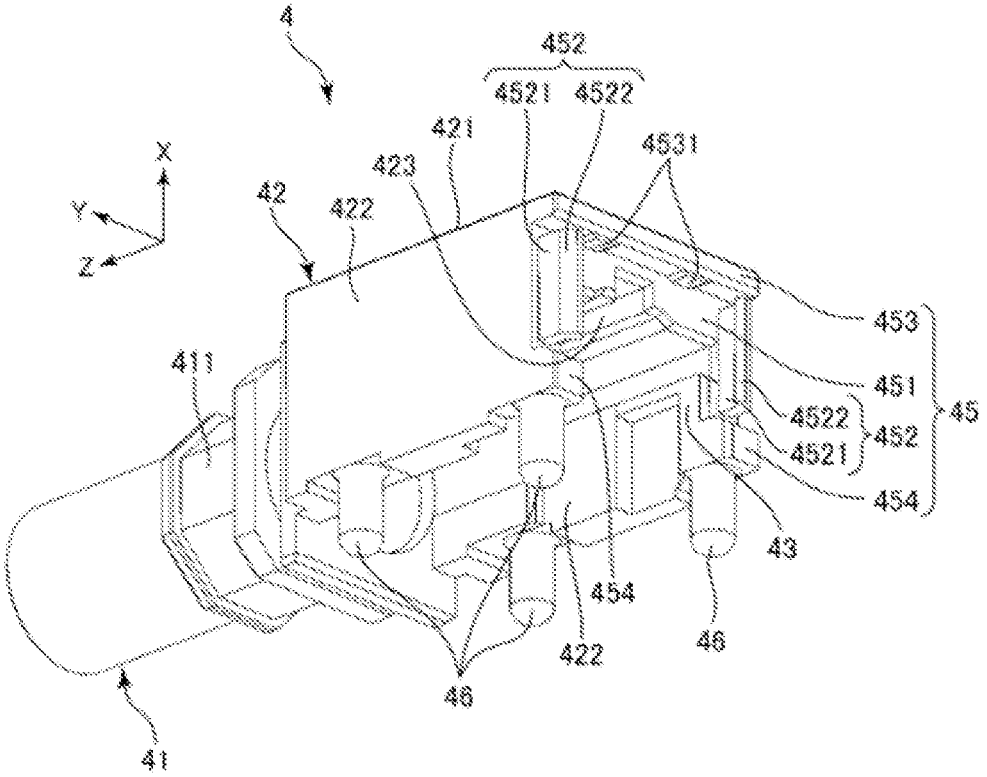
FIG. 9 is a perspective view illustrating a hold mechanism of a plug shell of an electrical connector according to the second embodiment of the present invention.
Figure 10A:
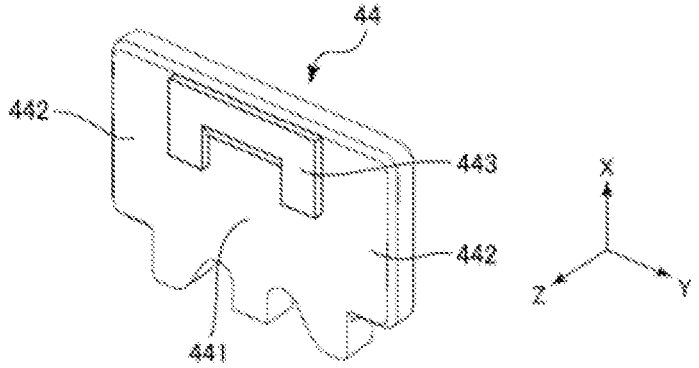
FIGS. 10A, 10B, and 10C are diagrams for a detailed description of one example of a lid member of the plug shell of the electrical connector according to the second embodiment and the hold state of the lid member.
Figure 10B:
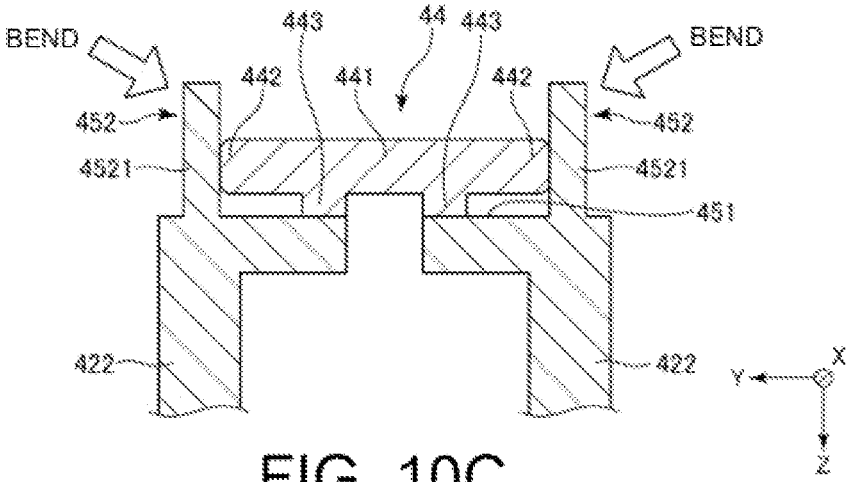
Figure 10C:
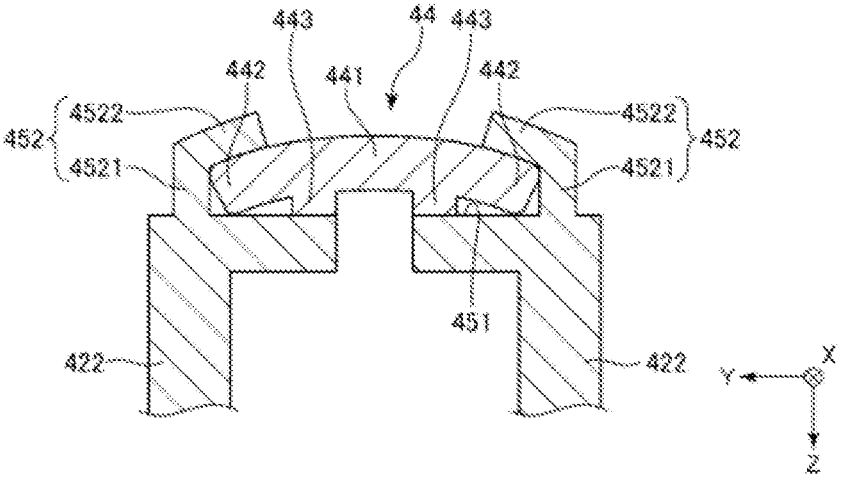
Figure 11A:
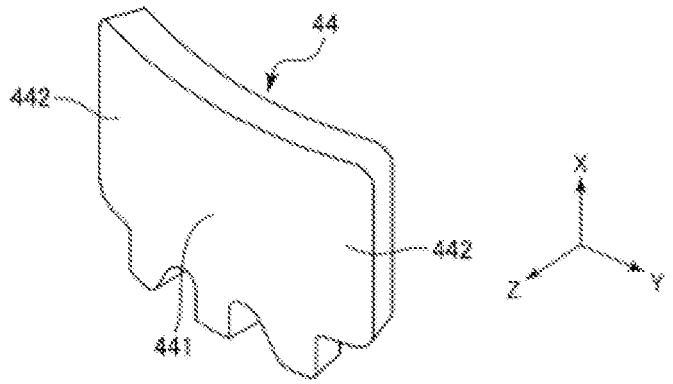
FIGS. 11A, 11B, and 11C are diagrams for a detailed description of another example of the lid member of the plug shell of the electrical connector according to the second embodiment and the hold state of the lid member.
Figure 11B:
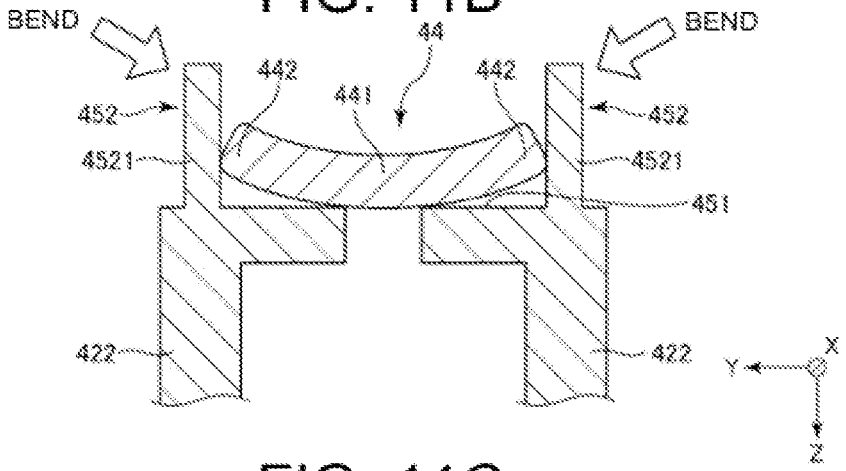
Figure 11C:
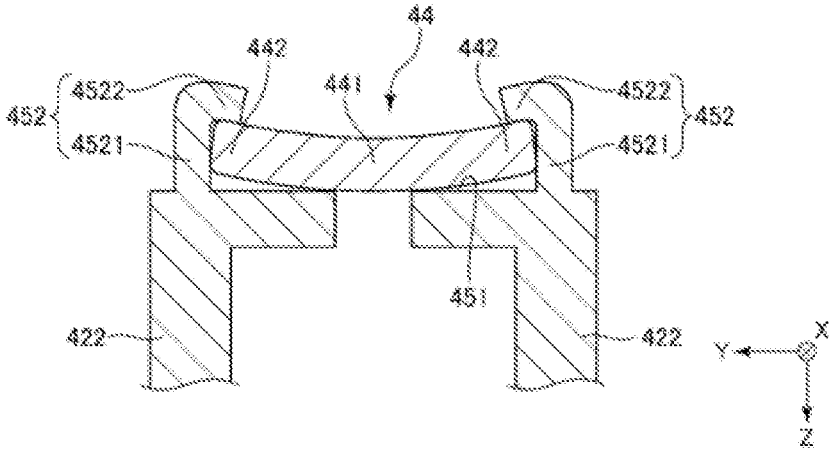
Figure 12A:
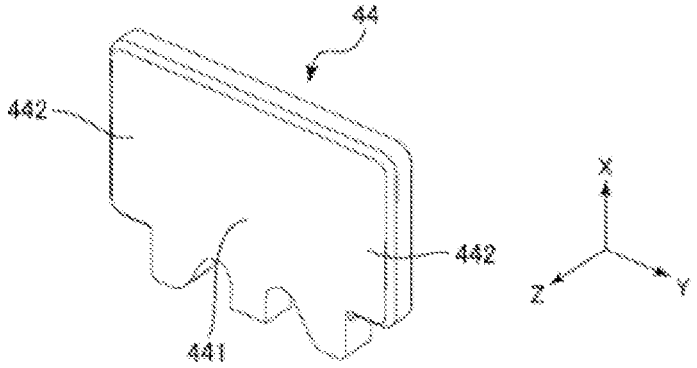
FIGS. 12A, 12B, and 12C are diagrams for a detailed description of a modification example of the hold mechanism of the plug shell of the electrical connector according to the second embodiment and the hold state of the lid member in the hold mechanism.
Figure 12B:
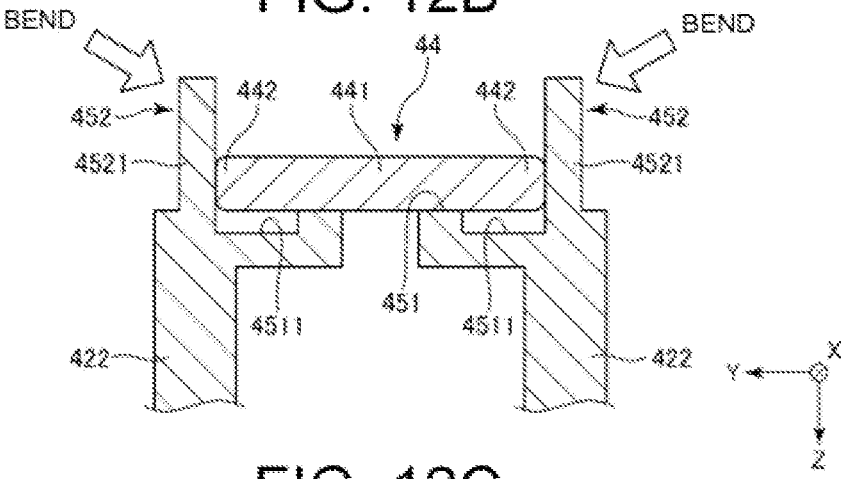
Figure 12C:
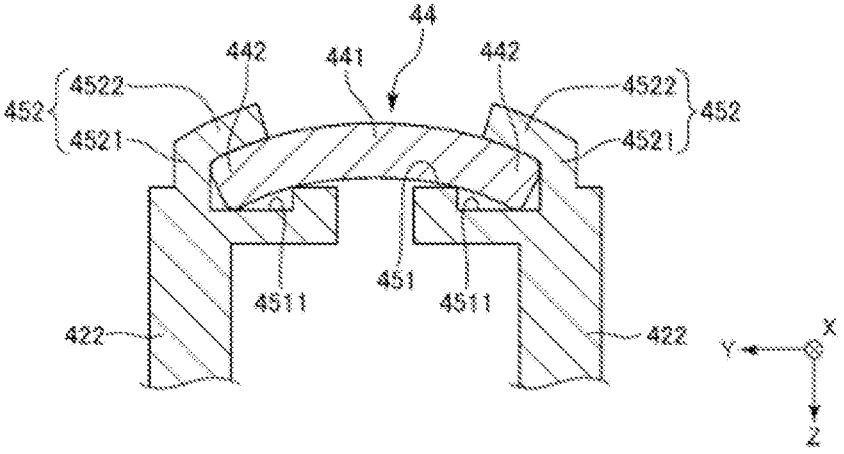

Next, with reference to FIG. 9 to FIGS. 12A, 12B, and 12C, the electrical connector according to the second embodiment of the present invention will be described in detail. FIG. 9 is a perspective view illustrating a hold mechanism of a plug shell of an electrical connector according to the second embodiment of the present invention. FIGS. 10A, 10B, and 10C are a diagram for a detailed description of one example of a lid member of the plug shell of the electrical connector according to the second embodiment and a hold state of the lid member. FIGS. 11A, 11B, and 11C are a diagram for a detailed description of another example of the lid member of the plug shell of the electrical connector according to the second embodiment and the hold state of the lid member. FIGS. 12A, 12B, and 12C are a diagram for a detailed description of a modification example of the hold mechanism of the plug shell of the electrical connector according to the second embodiment and the hold state of the lid member in the hold mechanism.

Hereinafter, regarding the electrical connector of the second embodiment, the differences from the electrical connector of the first embodiment will be mainly explained, and the explanations of the same matters will be omitted. Note that the electrical connector of the present embodiment is mounted on the circuit board 200 by the same mounting method as that of the electrical connector of the first embodiment. The electrical connector of the present embodiment has the same configuration as the electrical connector of the first embodiment, except that the configuration for generating a stress in the lid member to urge the pair of end portions of the lid member to become distant from the pedestal in a state where the lid member is held on the pedestal is different.

As illustrated in FIG. 9, in the plug shell 4 of the electrical connector 1 of the present embodiment, the protrusion portions 455 are not formed on the pedestal 451 of the hold mechanism 45. On the other hand, in one example, the lid member 44 has a flat plate shape with the protrusion portions 443 as illustrated in FIG. 10A in its natural state, and, in another example, the lid member 44 has a curved shape as illustrated in FIG. 11A in its natural state.

Firstly, an explanation will be given of the case in which the lid member 44 has a flat plate shape with the protrusion portions 443 as illustrated in FIG. 10A in its natural state. In this case, the lid member 44 has the protrusion portions 443 on the surface of the central portion 441 of the lid member 44 facing the pedestal 451. The protrusion portions 443 are formed in such a position and shape that the protrusion portions 443 make contact with the pedestal 451 when the lid member 44 is placed on the pedestal 451.

In FIG. 10B, the cross-sectional view of the pedestal 451, the pair of hold pieces 452, and the lid member 44 before the crimping operation is performed on the pair of hold pieces 452 is schematically illustrated. As illustrated in FIG. 10B, when the lid member 44 is placed on the pedestal 451 for assembling the electrical connector 1, the protrusion portions 443 of the lid member 44 make contact with the pedestal 451, so that the pair of end portions 442 of the lid member 44 are distant from the pedestal 451. If the crimping operation is performed on the pair of hold pieces 452 in this state so that the pressing portions 4522 are formed in the pair of hold pieces 452, respectively, the pair of end portions 442 of the lid member 44, which is placed on the pedestal 451, are curved and deformed toward the pedestal 451 by the pressing force applied from the pressing portions 4522 of the pair of hold pieces 452. In FIG. 10C, the cross-sectional view of the pedestal 451, the pair of hold pieces 452, and the lid member 44 after the crimping operation is performed on the pair of hold pieces 452 is schematically illustrated. As illustrated in FIG. 10C, the lid member 44 is held on the pedestal 451 by the pair of hold pieces 452 in a state where the pair of end portions 442 of the lid member 44 are curved and deformed toward the pedestal 451.

Next, an explanation will be given of the case in which the lid member 44 has a curved shape as illustrated in FIG. 11A in its natural state. In this case, the lid member 44 has a curved shape in which the pair of end portions 442 are positioned on the base end side (the −Z direction side) relative to the central portion 441 in its natural state. In FIG. 11B, the cross-sectional view of the pedestal 451, the pair of hold pieces 452, and the lid member 44 before the crimping operation is performed on the pair of hold pieces 452 is schematically illustrated. As illustrated in FIG. 11B, when the lid member 44 is placed on the pedestal 451 for assembling the electrical connector 1, the central portion 441 of the lid member 44 makes contact with the pedestal 451, and the pair of end portions 442 of the lid member 44 are distant from the pedestal 451. If the crimping operation is performed on the pair of hold pieces 452 in this state so that the pressing portions 4522 are formed in the pair of hold pieces 452, respectively, the pressing portions 4522 of the pair of hold pieces 452 press the pair of end portions 442 of the lid member 44, which are distant from the pedestal 451, toward the pedestal 451. Accordingly, the pair of end portions 442 of the lid member 44 placed on the pedestal 451 will be curved and deformed toward the pedestal 451. In FIG. 11C, the cross-sectional view of the pedestal 451, the pair of hold pieces 452, and the lid member 44 after the crimping operation is performed on the pair of hold pieces 452 is schematically illustrated. As illustrated in FIG. 11C, the lid member 44 is held on the pedestal 451 by the pair of hold pieces 452 in a state where the pair of end portions 442 of the lid member 44 are curved and deformed toward the pedestal 451.

As described above, also according to the present embodiment, the lid member 44 for closing the insertion port 43 is held on the pedestal 451 in a state of being curved and deformed from its natural state, or more specifically, in a state where the pair of end portions 442 of the lid member 44 are curved and deformed toward the pedestal 451. Therefore, in the state where the lid member 44 is held on the pedestal 451, a stress that urges the pair of end portions 442 of the lid member 44 to become distant from the pedestal 451 is generated in the lid member 44. Therefore, even if the pair of hold pieces 452 are heated by heat, etc., which is generated in a reflow step or the like performed for mounting the electrical connector 1 onto the circuit board 200 so that the pair of hold pieces 452 are deformed so as to open the pressing portions 4522, the pair of end portions 442 of the lid member 44 are elastically restored even more so as to follow the deformation of the pressing portions 4522 of the pair of hold pieces 452, and thus no separation is generated between the pressing portions 4522 of the pair of hold pieces 452 and the lid member 44. Therefore, the lid member 44 can be firmly held on the pedestal 451, so that the rocking movement of the lid member 44 on the pedestal 451 can be securely prevented.

Note that, in the present embodiment, although the protrusion portions 455 are formed in the lid member 44 or such a deformation to make the lid member 44 have a curved shape in its natural state, etc., is applied to the lid member 44 in order to generate a stress in the lid member 44 that urges the pair of end portions 442 of the lid member 44 to become distant from the pedestal 451 in a state where the lid member 44 is held on the pedestal 451, the present invention is not limited as such. For example, as described with reference to FIGS. 12A, 12B, and 12C, the modification example in which, by applying a deformation to the hold mechanism 45 of the plug shell 4, a stress that urges the pair of end portions 442 of the lid member 44 to become distant from the pedestal 451 can be generated in the lid member 44 in a state where the lid member 44 is held on the pedestal 451 is also within the range of the present invention.

In FIG. 12A, the lid member 44 which is held by the hold mechanism 45 in the present modification example is illustrated. In FIG. 12B, the cross-sectional view of the pedestal 451, the pair of hold pieces 452, and the lid member 44 before the crimping operation is performed on the pair of hold pieces 452 is schematically illustrated. In FIG. 12C, the cross-sectional view of the pedestal 451, the pair of hold pieces 452, and the lid member 44 after the crimping operation is performed on the pair of hold pieces 452 is schematically illustrated.

As illustrated in FIG. 12A, the lid member 44 which is held by the hold mechanism 45 in the present modification example has a flat plate shape in its natural state as in the first embodiment. As illustrated in FIG. 12B, in the present modification example, the concave portions 4511 are formed in the section facing the pair of end portions 442 of the lid member 44 on the pedestal 451 of the hold mechanism 45 of the plug shell 4. Therefore, when the lid member 44 is placed on the pedestal 451 for assembling the electrical connector 1, the central portion 441 of the lid member 44 makes contact with the pedestal 451, and the pair of end portions 442 of the lid member 44 are positioned on the upper side of the concave portions 4511 of the pedestal 451. If the crimping operation is performed on the pair of hold pieces 452 in this state so that the pressing portions 4522 are formed in the pair of hold pieces 452, respectively, the pair of end portions 442 of the lid member 44, which is placed on the pedestal 451, are curved and deformed toward the concave portions 4511 of the pedestal 451 by the pressing force applied from the pressing portions 4522 of the pair of hold pieces 452. As illustrated in FIG. 12C, the lid member 44 is held on the pedestal 451 by the pair of hold pieces 452 in a state where the pair of end portions 442 of the lid member 44 are curved and deformed toward the concave portions 4511 of the pedestal 451. Therefore, in the state where the lid member 44 is held on the pedestal 451, a stress that urges the pair of end portions 442 of the lid member 44 to become distant from the pedestal 451 is generated in the lid member 44. According to such a modification example as described above also, the lid member 44 can be firmly held on the pedestal 451, so that the rocking movement of the lid member 44 on the pedestal 451 can be securely prevented. Note that, in the modification example illustrated in FIGS. 12A, 12B, and 12C, although the concave portions 4511 are formed on the pedestal 451, it is also possible that the concave portions 4511 are through holes penetrating the pedestal 451.

Third Embodiment

Figure 13:
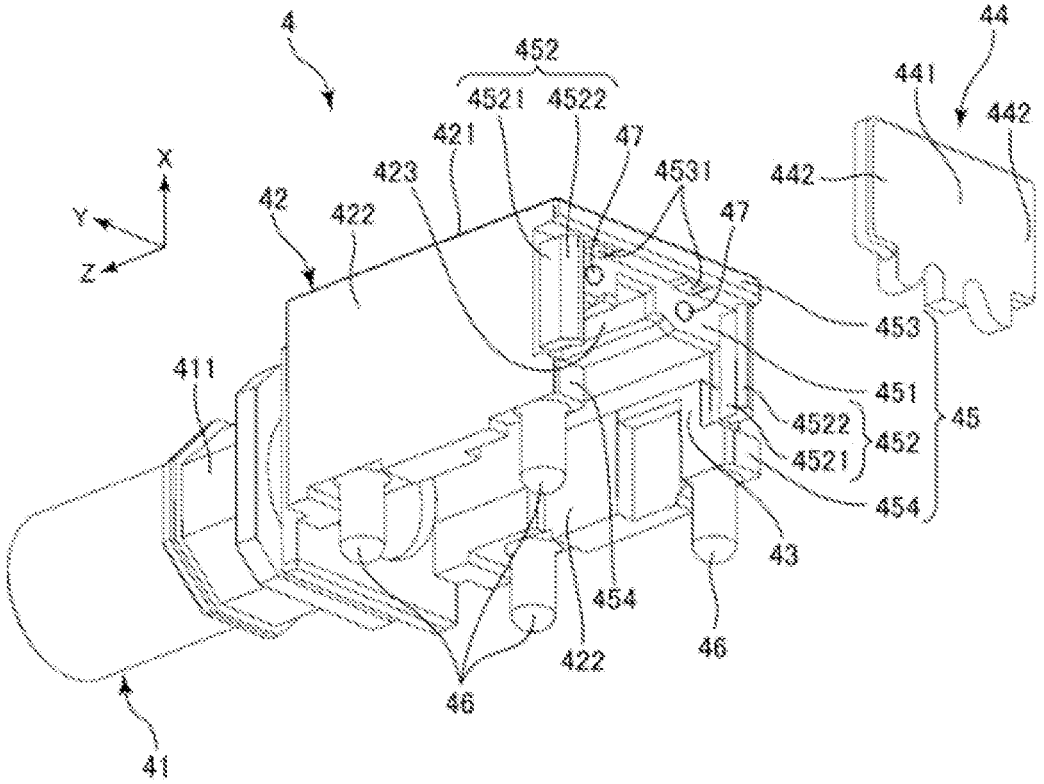
FIG. 13 is an exploded perspective view of a plug shell of an electrical connector according to the third embodiment of the present invention.

Next, with reference to FIG. 13, a plug shell and a connector according to the third embodiment of the present invention will be described in detail. FIG. 13 is an exploded perspective view of a plug shell of an electrical connector according to the third embodiment of the present invention.

Hereinafter, regarding the electrical connector of the third embodiment, the differences from the electrical connector of the first embodiment will be mainly explained, and the explanations of the same matters will be omitted. Note that the electrical connector of the present embodiment is mounted on the circuit board 200 by the same mounting method as that of the electrical connector of the first embodiment. The electrical connector of the present embodiment has the same configuration as the electrical connector of the first embodiment, except that the configuration for preventing the rocking movement of a lid member on a pedestal is different.

As illustrated in FIG. 13, in the plug shell 4 of the electrical connector 1 of the present embodiment, the lid member 44 has a flat plate shape in its natural state as in the first embodiment. Further, as in the second embodiment, the protrusion portions 455 are not formed on the pedestal 451 of the hold mechanism 45.

In the present embodiment, the lid member 44 for closing the insertion port 43 is held on the pedestal 451 in its natural state by the pair of hold pieces 452. That is, unlike the above-described first embodiment or second embodiment, the plug shell 4 of the present embodiment does not have a configuration for generating a stress in the lid member 44 that urges the pair of end portions 442 of the lid member 44 to become distant from the pedestal 451 in a state where the lid member 44 is held on the pedestal 451. Alternatively, as illustrated in FIG. 13, the plug shell 4 of the electrical connector 1 of the present embodiment includes the viscous material 47 which is applied onto the pedestal 451.

The viscous material 47 has a function of preventing the rocking movement of the lid member 44 on the pedestal 451 in the state where the electrical connector 1 is assembled. When assembling the electrical connector 1 of the present embodiment, the viscous material 47 is applied onto the pedestal 451. Note that, here, the viscous material 47 may be applied to the entire surface of the pedestal 451 facing the lid member 44 or may be applied only to a part of the surface of the pedestal 451 facing the lid member 44. Thereafter, the lid member 44 is placed on the pedestal 451 onto which the viscous material 47 is applied. Next, the crimping operation for forming the pressing portions 4522 is performed on the pair of hold pieces 452, so that the lid member 44 is pressed toward the pedestal 451 and fixed. In the state where electrical connector 1 is assembled, the viscous material 47 is positioned between the lid member 44 and the pedestal 451.

The viscous material 47 prevents the rocking movement of the lid member 44 on the pedestal 451 with its own viscosity. As the viscous material 47 described above, grease such as one that is in a liquid form at the room temperature or under the usage environment of the electrical connector 1 and is generally used for an anti-slip purpose (e.g., Sankei Chemical's "Sankol TKG-6") or adhesive such as silicon-based adhesive (for example, one that is manufactured by Toray Dow Corning Ltd.) can be used.

As described above, in the present embodiment, the viscous material 47 exists between the lid member 44 and the pedestal 451. Therefore, even if the pair of hold pieces 452 are heated by heat, etc., which is generated in a reflow step or the like performed for mounting the electrical connector 1 onto the circuit board 200 so that the pair of hold pieces 452 are deformed so as to open the pressing portions 4522, it is possible to prevent the rocking movement of the lid member 44 on the pedestal 451 by the viscosity of the viscous material 47.

Although the electrical connectors of the present invention and the method for mounting the electrical connectors were explained based on the embodiments illustrated in the drawings, the present invention is not limited as such. It is possible that each configuration of the present invention is replaced with a given configuration that can exert a similar function, or a given configuration can be added to each configuration of the present invention.

Those skilled in the field and art to which the present invention belongs would be able to implement modifications in the configurations of the electrical connectors of the described invention without significantly departing from the principle, idea, and range of the present invention. Further, the electrical connectors having the modified configurations are also within the range of the present invention.

Further, the number and type of constituent elements of the electrical connectors illustrated in the drawings are merely examples for the explanations, and the present invention is not necessarily limited as such. To the extent that does not depart from the principle and intent of the present invention, forms in which given components are added or combined or in which given components are deleted are also within the range of the present invention.

Figure 14:
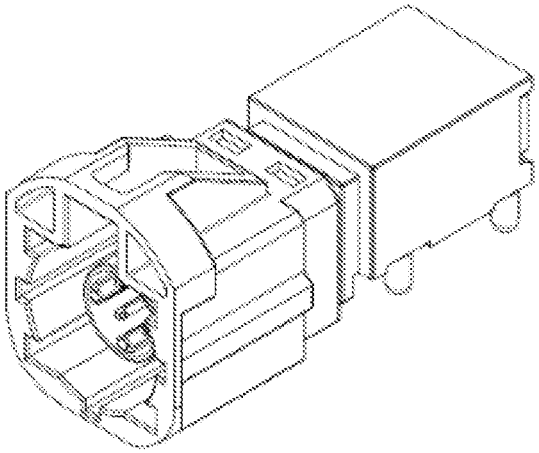
FIG. 14 is a perspective view of the electrical connector according to the first embodiment of the present invention.
Figure 15:
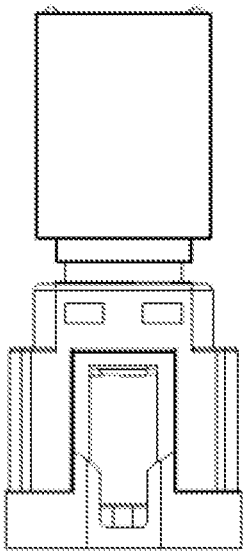
FIG. 15 is a plan view of the electrical connector according to the first embodiment of the present invention.
Figure 16:
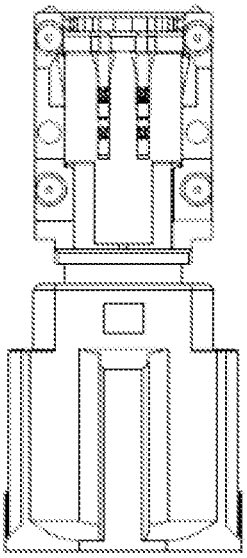
FIG. 16 is a bottom view of the electrical connector according to the first embodiment of the present invention.
Figure 17:
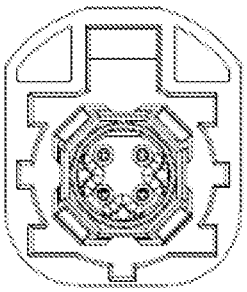
FIG. 17 is a front view of the electrical connector according to the first embodiment of the present invention.
Figure 18:
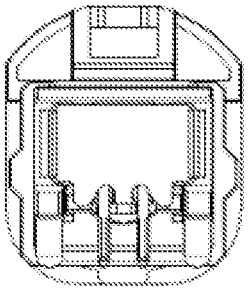
FIG. 18 is a rear view of the electrical connector according to the first embodiment of the present invention.
Figure 19:
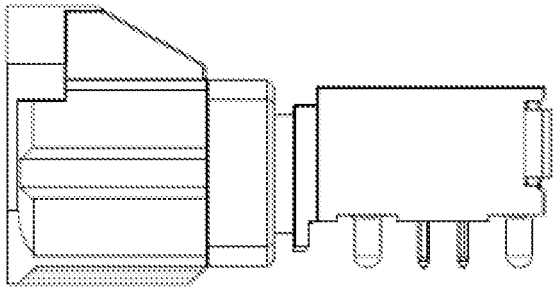
FIG. 19 is a left side view of the electrical connector according to the first embodiment of the present invention.
Figure 20:
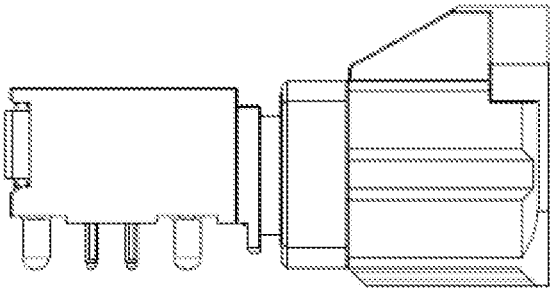
FIG. 20 is a right side view of the electrical connector according to the first embodiment of the present invention.

Further, for reference, a precise perspective view and six planar views of the electrical connector according to the first embodiment of the present invention are illustrated in FIG. 14 to FIG. 20. FIG. 14 is a perspective view of the electrical connector according to the first embodiment of the present invention. FIG. 15 is a plan view of the electrical connector according to the first embodiment of the present invention. FIG. 16 is a bottom view of the electrical connector according to the first embodiment of the present invention. FIG. 17 is a front view of the electrical connector according to the first embodiment of the present invention. FIG. 18 is a rear view of the electrical connector according to the first embodiment of the present invention. FIG. 19 is a left side view of the electrical connector according to the first embodiment of the present invention. FIG. 20 is a right side view of the electrical connector of the present invention.

What is claimed is:

1. An electrical connector comprising a plug shell, the plug shell including an accommodation portion accommodating a contact pin and a housing that holds the contact pin, an insertion port inserting the contact pin and the housing into the accommodation portion, a lid member closing the insertion port, and a hold mechanism holding the lid member, wherein the hold mechanism is equipped with a pedestal, on which the lid member is placed, and a pair of hold pieces, which hold the lid member on the pedestal by pressing the lid member onto the pedestal, wherein the lid member has a central portion and end portions which are positioned on both sides of the central portion, and wherein the pair of hold pieces press the end portions of the lid member toward the pedestal, so that thereby a stress that urges the end portions of the lid member to become distant from the pedestal is generated in the lid member.

2. The electrical connector according to claim 1, wherein the hold mechanism is further equipped with a protrusion portion which is formed on the pedestal, and wherein the protrusion portion pushes up the central portion of the lid member in a direction away from the pedestal.

3. The electrical connector according to claim 1, wherein the lid member is equipped with a protrusion portion which is formed on a surface of the central portion facing the pedestal, and wherein the protrusion portion of the lid member makes contact with the pedestal, so that thereby the central portion of the lid member is pushed up in a direction away from the pedestal.

4. The electrical connector according to claim 1, wherein the lid member has such a curved shape that, when the lid member is placed on the pedestal, the central portion is in contact with the pedestal and the end portions are distant from the pedestal, and wherein the pair of hold pieces press the end portions of the lid member, which are distant from the pedestal, toward the pedestal, so that thereby the stress that urges the end portions of the lid member to become distant from the pedestal is generated in the lid member.

5. The electrical connector according to claim 1, wherein each of the pair of hold pieces has an extending portion, which linearly extends along a thickness direction of the lid member from the pedestal, and a pressing portion, which extends from a tip of the extending portion so as to make contact with an upper face of the lid member, and wherein the pressing portion of the pair of hold pieces holds the lid member on the pedestal by pressing the lid member onto the pedestal.

* * * * *